US005950509A

United States Patent [19]

Doong

[11] Patent Number: 5,950,509

[45] Date of Patent: Sep. 14, 1999

[54] FASTENER COUPLER FOR POWER TOOL

[76] Inventor: Chien Lin Doong, No. 96, Lane 521, Chong San Road, Ahlien Hsiang, Kaohsiung Hsien, Taiwan

[21] Appl. No.: 09/006,303

[22] Filed: Jan. 13, 1998

[51] Int. Cl.[6] ..... B25B 23/157

[52] U.S. Cl. ..... 81/475; 81/473

[58] Field of Search ..... 81/475, 473, 476; 192/34, 69.82, 69.81, 69.83

[56] References Cited

U.S. PATENT DOCUMENTS

| | | | |
|---|---|---|---|
| 2,271,673 | 2/1942 | Zenner | 178/34 |
| 2,977,832 | 4/1961 | Bless | 81/476 |
| 3,165,325 | 1/1965 | Goepfrich et al. | 279/147 |
| 4,161,242 | 7/1979 | Moores, Jr. et al. | 192/34 |

FOREIGN PATENT DOCUMENTS

| | | | |
|---|---|---|---|
| 2-131876 | 5/1990 | Japan | 81/473 |
| 1 333 841 | 10/1973 | United Kingdom | 81/475 |
| 2 062 524 | 5/1981 | United Kingdom | 81/475 |

*Primary Examiner*—David A. Scherbel
*Assistant Examiner*—Philip J. Hoffmann

[57] ABSTRACT

A coupler for coupling a fastener to a power tool includes a barrel, and a head and a follower rotatably engaged in the barrel and each having one or more projections for engaging with each other and for allowing the follower to be driven by the head. The follower may engage with the fastener to be threaded. The head includes a shaft extended outward of the barrel for coupling to the power tool. A limit member is secured to the shaft for limiting a relative movement of the head to the follower and for allowing the follower to be disengaged from the head.

5 Claims, 7 Drawing Sheets

FASTENER COUPLER FOR POWER TOOL

BACKGROUND OF THE INVENTION

1. Field of the Invention

The present invention relates to a coupler, and more particularly to a coupler for coupling a fastener to a power tool.

2. Description of the Prior Art

Typical power tools comprise a motor driven device for driving a fastener via a stem. The fastener may be over rotated such that both the fastener and the stem of the power tool may be damaged.

The present invention has arisen to mitigate and/or obviate the afore-described disadvantages of the conventional power tools.

SUMMARY OF THE INVENTION

The primary objective of the present invention is to provide a coupler for coupling a fastener to a power tool and for preventing the fastener and the power tool from being damaged.

In accordance with one aspect of the invention, there is provided a coupler for coupling a fastener to a power tool, the coupler comprising a barrel including a first end and a second end for engaging with an object to be threaded with the fastener, a head rotatably engaged in the barrel and including a first end having a shaft extended outward of the first end of the barrel for coupling to the power tool, the head including a second end having at least one first projection, a follower rotatably engaged in the barrel and including a first end for engaging with the fastener and including a second end having at least one second projection for engaging with the first projection and for allowing the follower to be driven by the head, and a limit member secured to the shaft for engaging with the barrel and for limiting a relative movement of the head to the follower and for allowing the follower to be disengaged from the head when the second end of the barrel is engaged with the object. A spring member may bias the follower away from the head.

The barrel includes a ring secured to the second end of the barrel for engaging with the follower and for preventing the follower from being disengaged from the barrel. The barrel includes a ring secured to the first end of the barrel for engaging with the head and for preventing the head from being disengaged from the barrel.

The barrel includes a cap secured to the first end of the barrel, the cap includes a bore, the shaft includes a threaded portion extended through the bore of the cap, the limit member is a bolt for threadedly engaging with the threaded portion of the shaft and for engaging with the cap and for limiting the relative movement of the head to the follower.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
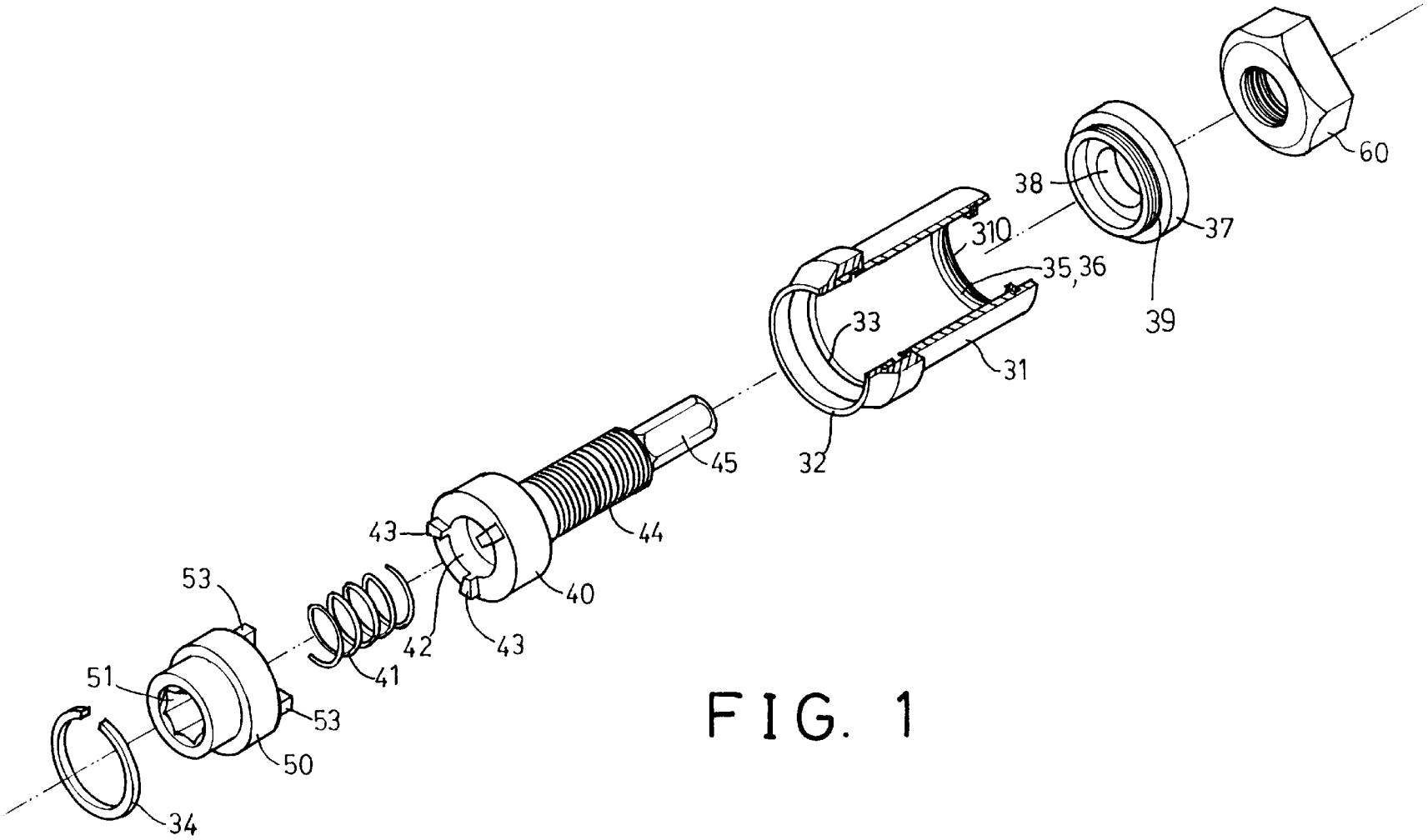
FIG. 1 is an exploded view of a fastener coupler for a power tool in accordance with the present invention.
Figure 2:
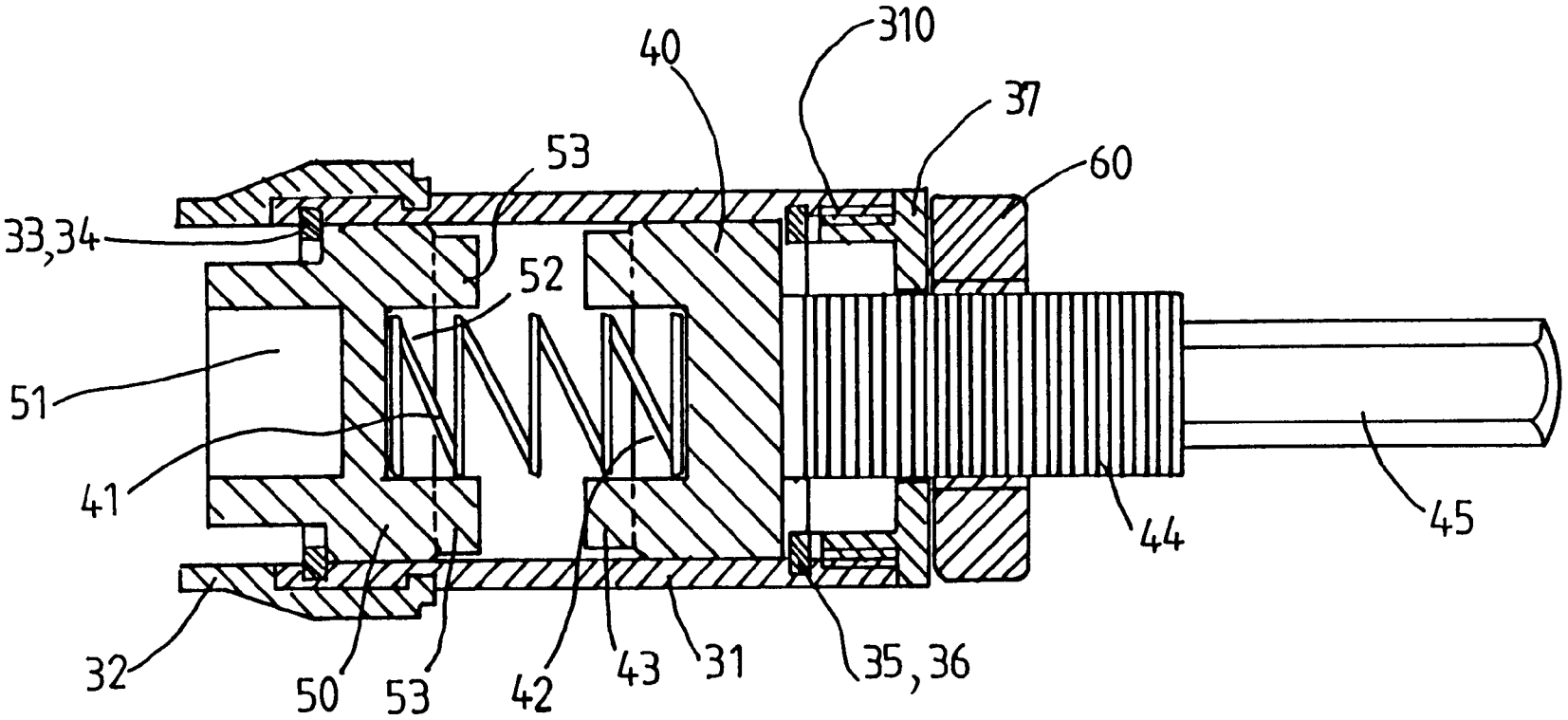
FIG. 2 is a cross sectional view of the fastener coupler.

Referring to the drawings, and initially to FIGS. 1 and 2, a fastener coupler in accordance with the present invention comprises a barrel 31 including an annular groove 33 formed in one end for engaging with a ring 34 and including another annular groove 35 formed in the other end for engaging with another ring 36. A sleeve 32 is secured to the one end of the barrel 31. The other end of the barrel 31 includes an inner thread 310 for engaging with an outer thread 39 of a cap 37 which includes a bore 38.

Figure 5:
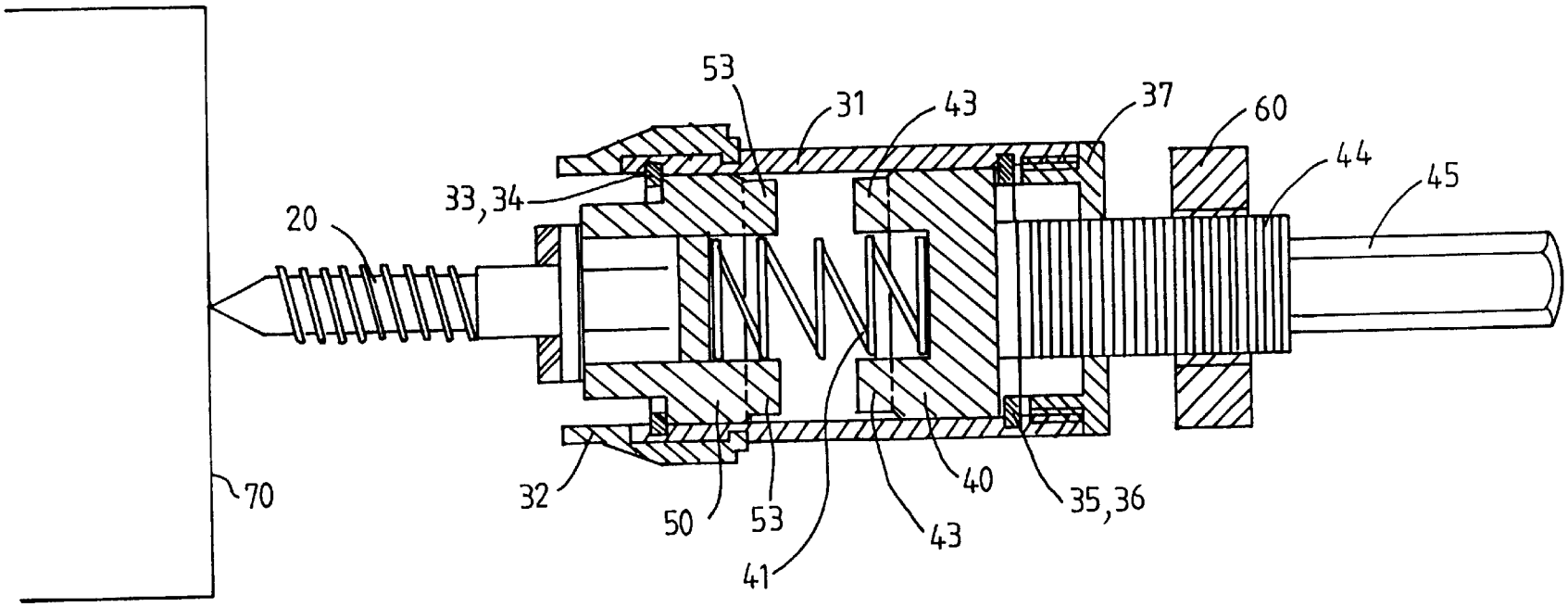
FIG. 5 is a cross sectional view similar to FIG. 3, in which the head is not secured to the barrel.
Figure 6:
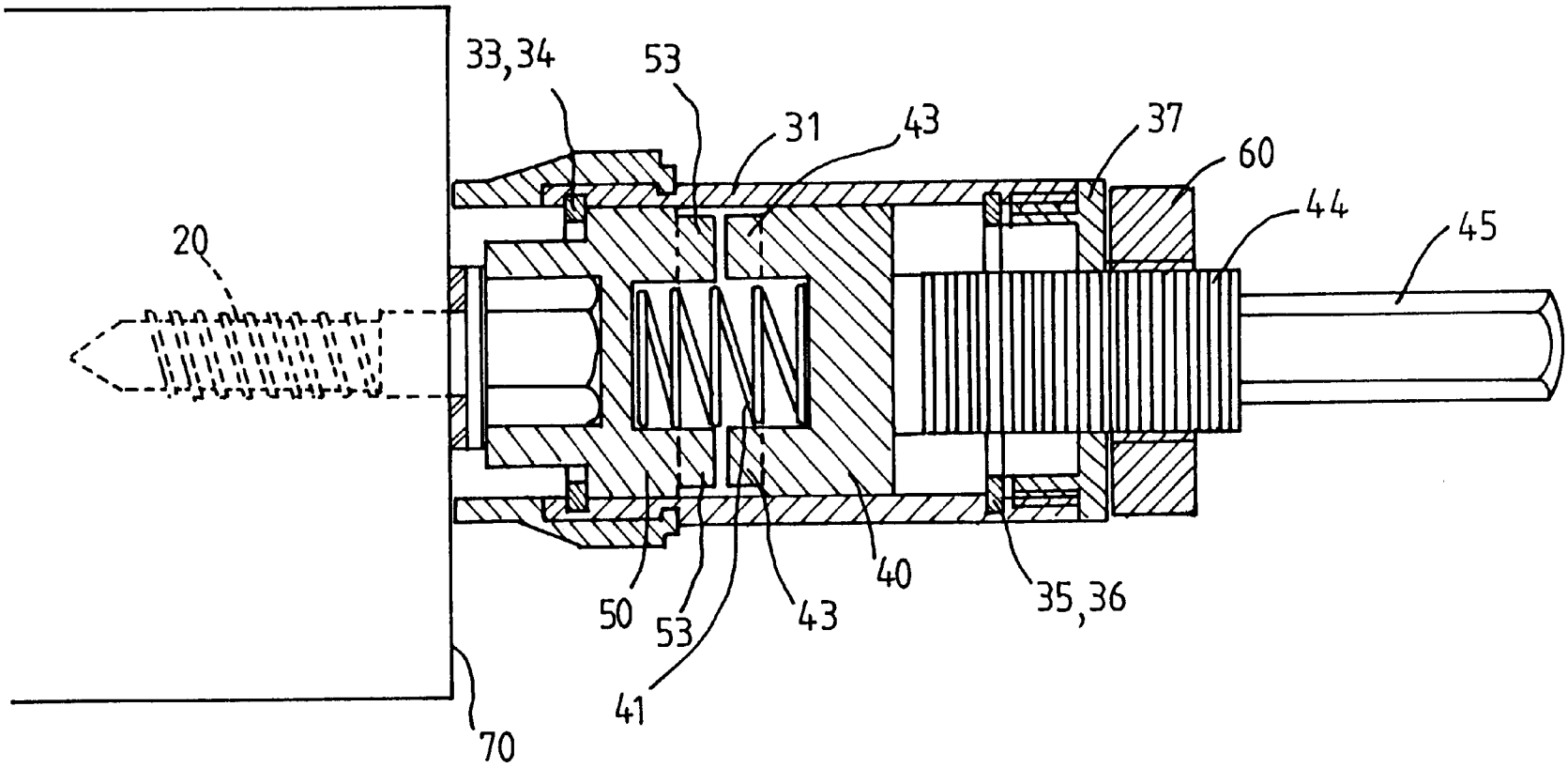
FIG. 6 is a cross sectional view illustrating the driving of the fastener into the object by the fastener coupler as shown in FIG. 5.

A head 40 is rotatably engaged in the barrel 31 and includes a bolt 44 and a shaft 45 extended through the bore 38 of the cap 37. A nut 60 is threadedly engaged with the bolt 44 for securing the head 40 to the barrel 31 (FIGS. 2–4) or for forming a limiting member for limiting the sliding movement of the head 40 relative to the barrel 31 (FIGS. 5, 6). The ring 36 may engage with the head 40 for preventing the head 40 from being disengaged from the barrel 31. The shaft 45 is provided for securing to a power tool and for allowing the power tool to rotate the head 40 and/or the barrel 31. The head 40 includes a cavity 42 for engaging with a spring 41 and includes one or more projections 43.

Figure 7:
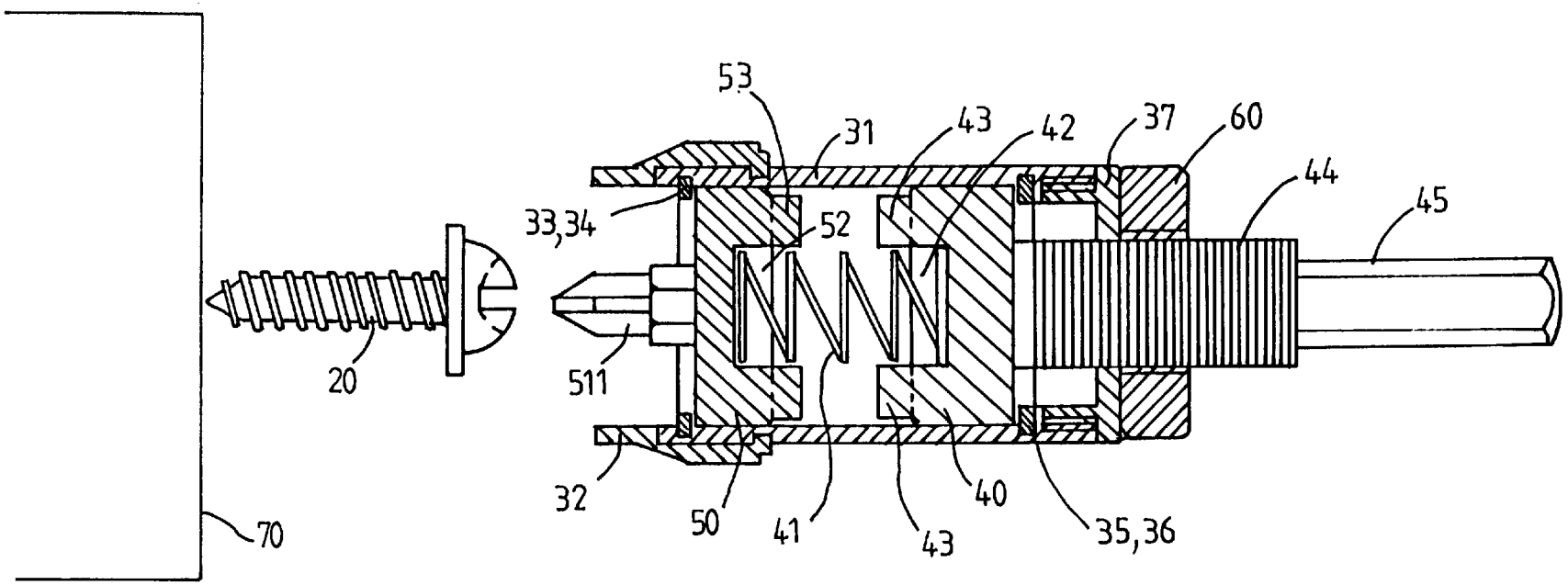
FIG. 7 is a cross sectional view illustrating the engagement and the driving of a screw with the fastener coupler.

A follower 50 is rotatably engaged in the barrel 31 and includes one or more projections 53 for engaging with that of the head 40 and for allowing the head 40 to rotate the follower 50 when the head 40 is rotated by the power tool. The follower 50 includes an engaging hole 51 for engaging with a fastener 20 (FIGS. 2–6) or for engaging with a tool bit 511 which may engage with the fastener 20 (FIG. 7). The spring 41 is engaged with the follower 50 for biasing the follower 50 to engage with the ring 34 and for biasing the fastener 20 to engage with the object 70 to be threaded with the fastener 20. The ring 34 may prevent the follower 50 from being disengaged from the barrel 31.

Figure 3:
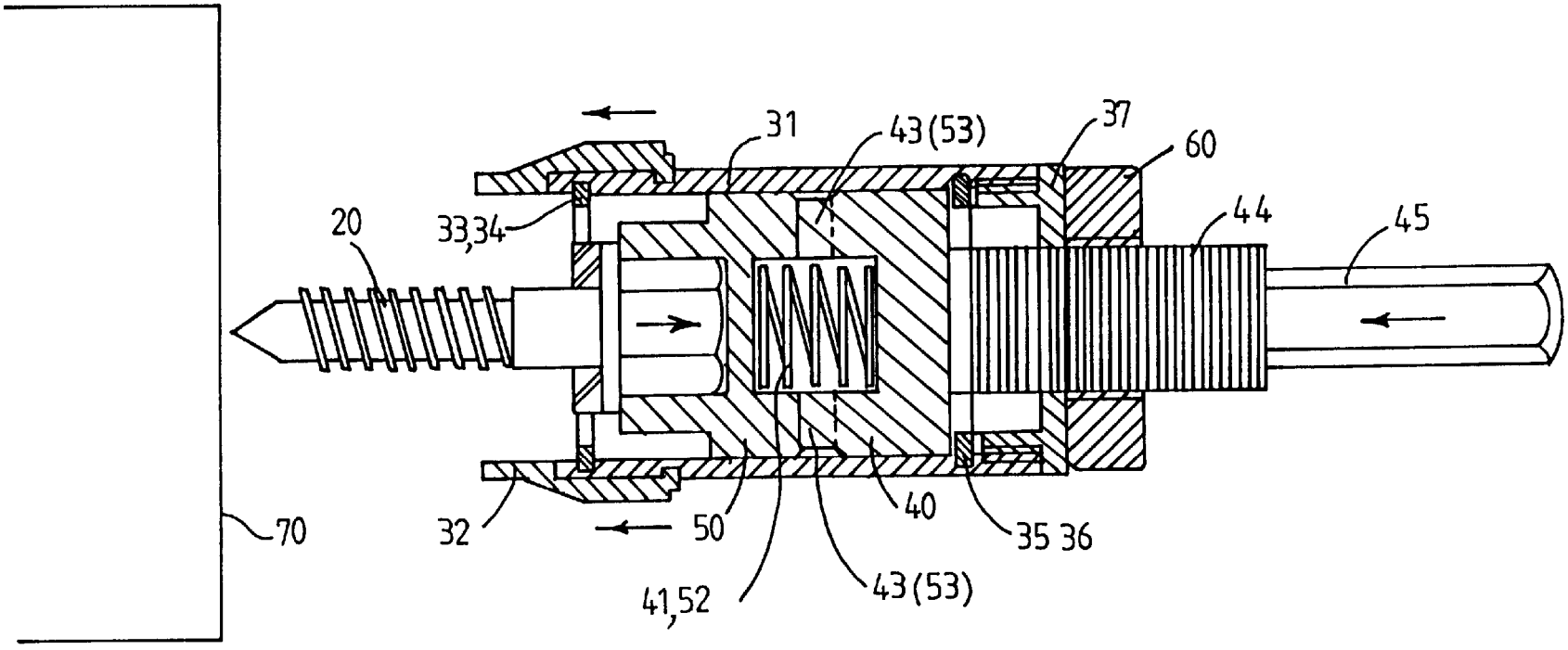
FIG. 3 is a cross sectional view illustrating the engagement of a fastener into the fastener coupler.
Figure 4:
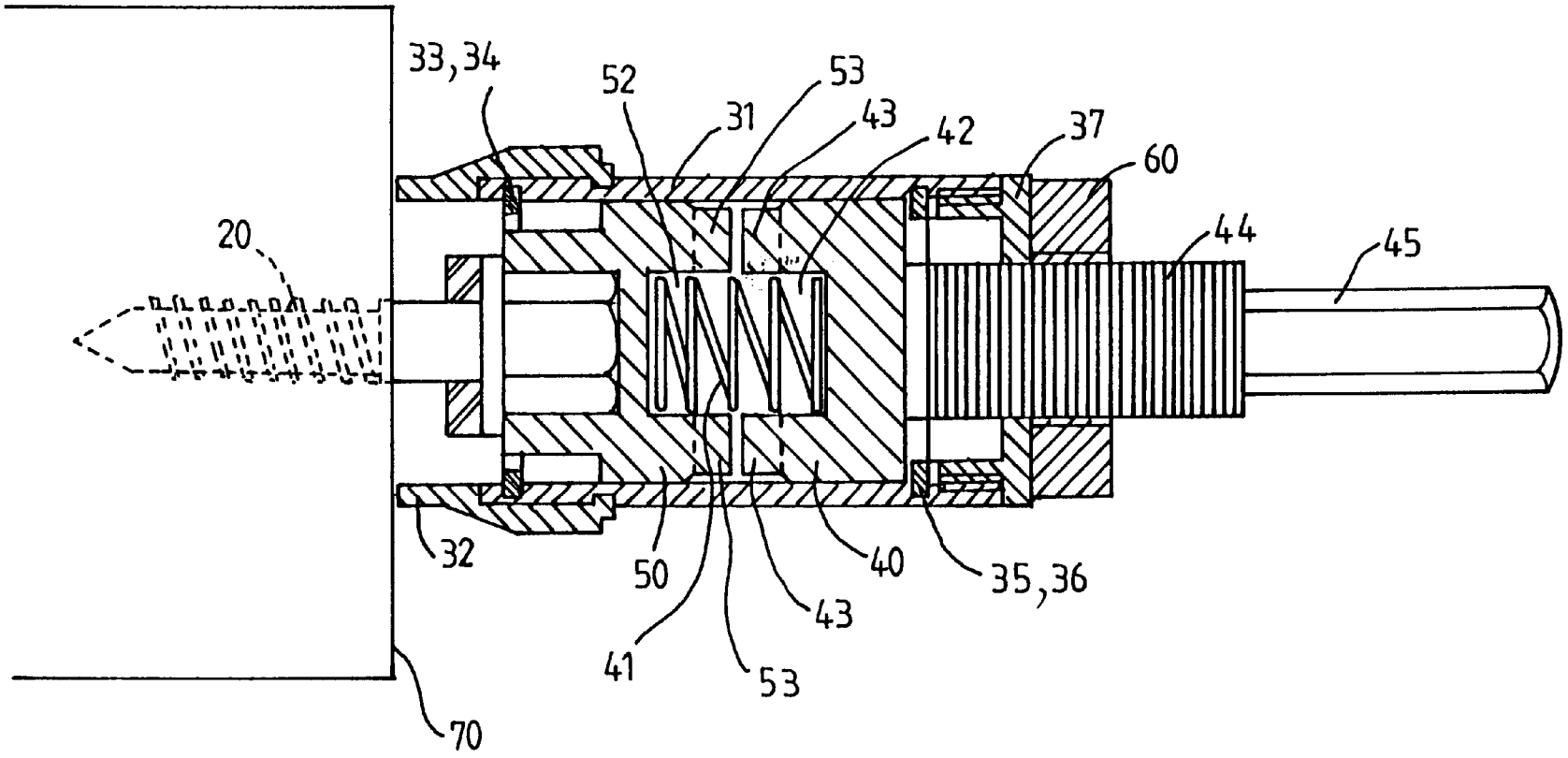
FIG. 4 is a cross sectional view illustrating the driving of the fastener into the object.

In operation, as shown in FIGS. 3 and 4, the head 40 is secured to the barrel 31 by the nut 60 and may be rotatably engaged in the barrel 31 but may not move longitudinally in the barrel 31. As shown in FIG. 3, when the barrel 31 is forced toward the object 70, the follower 50 may be moved toward the head 40 against the spring 41 until the projections 43, 53 of the head and of the follower 50 are engaged with each other. At this moment, the follower 50 and the fastener 20 may be driven by the power tool via the head 40. As shown in FIG. 4, when the fastener 20 is threaded into the object 70 and when the sleeve 32 is engaged with the object 70, the head 40 may no longer move toward the object 70 and is limited by the barrel 31 and the nut 60. The follower 50 may still be rotated by the head 40 until the projections 53 of the follower 50 are disengaged from that of the head 40 and until the fastener 20 is fully engaged into the object 70. The follower 50 and the fastener 20 then may not be further driven by the head 40 when the head 40 and the follower 50 are disengaged from each other. The fastener 20 and the power tool thus will not be damaged.

As shown in FIGS. 5 and 6, the head 40 is not secured to the barrel 31 and may move longitudinally in the barrel 31. As shown in FIG. 5, when the barrel 31 is forced toward the object 70, the head 40 may be moved toward the follower 50 against the spring 41 until the projections 43, 53 of the head and of the follower 50 are engaged with each other. At this moment, the follower 50 and the fastener 20 may be driven by the power tool via the head 40. As shown in FIG. 6, when the fastener 20 is threaded into the object 70 and when the sleeve 32 is engaged with the object 70, the movement of the head 40 relative to the object 70 is limited by the barrel 31 and the nut 60 such that the follower 50 may still be rotated by the head 40 until the projections 53 of the follower 50 are disengaged from that of the head 40 and until the fastener 20 is fully engaged into the object 70. The follower 50 and the fastener 20 then may not be further driven by the head 40 when the head 40 and the follower 50 are disengaged from each other. The fastener 20 and the power tool thus will not be damaged.

Accordingly, the fastener coupler in accordance with the present invention may be provided for coupling a fastener to a power tool and for preventing the fastener and the power tool from being damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A coupler for coupling a fastener to a power tool, said coupler comprising:

a barrel including a first end, and a second end for engaging with an object to be threaded with the fastener, a head rotatably engaged in said barrel and including a first end having a shaft extended outward of said first end of said barrel for coupling to the power tool, said head including a second end having at least one first projection, a follower rotatably engaged in said barrel and including a first end for engaging with the fastener and including a second end having at least one second projection for engaging with said at least one first projection and for allowing said follower to be driven by said head, and a limit member secured to said shaft for engaging with said barrel and for limiting a relative movement of said head to said follower and for allowing said follower to be disengaged from said head when said second end of said barrel is engaged with the object.

2. The coupler according to claim 1 further comprising means for biasing said follower away from said head.

3. The coupler according to claim 1, wherein said barrel includes a ring secured to said second end of said barrel for engaging with said follower and for preventing said follower from being disengaged from said barrel.

4. The coupler according to claim 1, wherein said barrel includes a ring secured to said first end of said barrel for engaging with said head and for preventing said head from being disengaged from said barrel.

5. The coupler according to claim 1, wherein said barrel includes a cap secured to said first end of said barrel, said cap includes a bore, said shaft includes a threaded portion extended through said bore of said cap, said limit member is a bolt for threadedly engaging with said threaded portion of said shaft and for engaging with said cap and for limiting the relative movement of said head to said follower.

* * * * *